United States Patent [19]

Wehle et al.

[11] Patent Number: 5,065,708

[45] Date of Patent: Nov. 19, 1991

[54] INTERNAL COMBUSTION ENGINE FOR A PORTABLE HANDHELD WORK APPARATUS

[75] Inventors: Anton Wehle, Fellbach; Klaus Höppner, Marbach; Hermann Weiss, Steinheim, all of Fed. Rep. of Germany

[73] Assignee: Andreas Stihl, Waiblingen, Fed. Rep. of Germany

[21] Appl. No.: 607,663

[22] Filed: Nov. 1, 1990

[30] Foreign Application Priority Data

Nov. 3, 1989 [DE] Fed. Rep. of Germany ..... 3936629

[51] Int. Cl.[5] ..... F02M 29/00

[52] U.S. Cl. ..... 123/52 MC; 123/73 C

[58] Field of Search ..... 123/187.5 R, 73 A, 73 B, 123/73 C, 52 M, 52 MC

[56] References Cited

U.S. PATENT DOCUMENTS

| | | | |
|---|---|---|---|
| 3,975,468 | 8/1976 | Tuckey | 123/52 M |
| 4,228,770 | 10/1980 | Boyesen | 123/73 A |
| 4,474,145 | 10/1984 | Boyesen | 123/73 A |
| 4,711,225 | 12/1987 | Holderle et al. | 123/52 M |
| 4,819,589 | 4/1989 | Nagashima | 123/52 M |
| 4,835,866 | 6/1989 | Nagashima | 123/73 AD |
| 4,890,586 | 1/1990 | Fujii et al. | 123/52 M |
| 4,903,644 | 2/1990 | Groger et al. | 123/52 MC |
| 4,971,008 | 11/1990 | Morishita | 123/52 M |

FOREIGN PATENT DOCUMENTS

| | | | |
|---|---|---|---|
| 2111591 | 7/1983 | United Kingdom | 123/73 A |

*Primary Examiner*—David A. Okonsky

*Attorney, Agent, or Firm*—Walter Ottesen

[57] ABSTRACT

The invention is directed to an internal combustion engine for a portable handheld work apparatus with an intake pipe or induction elbow being attached to the cylinder. The engine can be a two-stroke engine having an inlet opening in the cylinder for the combustion mixture. A cylinder flange is provided at the inlet opening for connecting the induction elbow for conducting the combustion mixture. The induction elbow is made of rubber-elastic material and fits over the cylinder flange in a form-tight manner and is fixed thereto. The connecting end of the induction elbow is provided with an inner annular shoulder which engages an outer annular slot of the cylinder flange which is adapted with respect to volume and is reliably held by a clamp ring having a fixed diameter. The rubber-elastic material of the connecting end is compressed in the annular slot by the clamp ring thereby seating the induction elbow on the cylinder flange in such a manner that it cannot become disconnected.

15 Claims, 3 Drawing Sheets

INTERNAL COMBUSTION ENGINE FOR A PORTABLE HANDHELD WORK APPARATUS

FIELD OF THE INVENTION

The invention relates to an internal combustion engine for a portable handheld work apparatus such as a motor-driven chain saw, brushcutter, cutoff machine or the like. The engine is preferably a two-stroke engine and includes a cylinder having an inlet opening for the combustion mixture and a cylinder flange for connecting an induction elbow through which the combustion mixture is supplied to the cylinder. The induction elbow is made of rubber-elastic material which engages over the cylinder flange in a form-tight manner and is reliably secured thereon.

BACKGROUND OF THE INVENTION

In a known arrangement, the connecting end of the induction elbow is fixed to the cylinder flange of the inlet opening by a conventional hose clamp. During assembly, the diameter of such a hose clamp becomes less thereby causing the hose clamp to seat tightly on the connecting end. The induction elbow is advantageously made of a rubber-elastic material to decouple the motor vibrations from the carburetor. Because the induction elbow is made of this material, the material becomes squeezed during assembly because of the relative movement between the clamp and the connecting end and this leads to the formation of fissures and leaks at the elbow. Accordingly, the suggestion has been made to provide a clamp ring between the hose clamp and the connecting end in order to separate the relative movement of the hose clamp from the rubber-elastic material of the connecting end and to apply the clamping forces via two half-shells of the clamp ring.

For assembly, the connecting end must be carefully placed over the cylinder flange of the inlet opening and thereafter the clamp ring is pushed thereover with the hose clamp being pulled tightly on the clamp ring. This is time consuming and inconvenient because of the number of parts. In this connection, consideration should be given to the fact that the cylinder flange is also used for holding an air guide wall. The air guide wall is mounted when installing the engine in the housing of a work apparatus and functions to guide the cooling air flow.

The many parts utilized to attach the induction elbow to the cylinder flange prevent a simple attachment of the air guide wall.

The suggestion has already been made to slip the air guide wall onto the cylinder flange and to attach the induction elbow to the air guide wall. Temperature problems occur because of the direct contact of the air guide wall to the hot cylinder on the cylinder flange. For this reason, a configuration of this kind is complex to assemble since the air guide wall must be mounted tightly on the cylinder flange and the induction elbow must be seated tightly on the air guide wall.

SUMMARY OF THE INVENTION

It is an object of the invention to provide an attachment arrangement including fewer parts for connecting the induction elbow to the cylinder flange of a cylinder. It is a further object of the invention to provide such an attachment arrangement wherein the attachment of the assembly of an air guide wall is not prevented.

The internal combustion engine of the invention is for a portable handheld tool such as a motor-driven chain saw, cutoff machine or the like. The internal combustion engine includes: a cylinder having a cylinder wall defining a combustion chamber; the cylinder wall having an inlet opening formed therein for passing a combustion mixture into the combustion chamber; the cylinder wall defining a cylinder flange formed in surrounding relationship to the inlet opening; an induction elbow for passing the combustion mixture into the inlet opening, the induction elbow being made of a material having a rubber elasticity and having a connecting end for connecting the induction elbow to the flange; the connecting end defining an inner wall surface having an annular shoulder formed thereon; the flange having an annular slot formed therein so as to have a volume adapted to the shoulder; the connecting end being mounted on the flange with the shoulder being disposed in the slot; and, a clamp ring having a fixed diameter and the clamp ring being pushed over the connecting end for holding the connecting end on the flange while compacting the material of the connecting end.

An axial form-tight connection of the induction elbow to the cylinder flange is obtained with the annular shoulder of the connecting end engaging the annular slot formed in the cylinder flange. The clamp ring is pushed over the connecting end and has an inner diameter such that the clamp ring compresses the rubber-elastic material of the connecting end which lies in the region of the annular slot such that the material is reduced in volume. Thus, the rubber-elastic material is pressed into the annular slot. The rubber-elastic material is approximately fitted into the space delimited by the annular slot and the clamp ring. For this reason, a stiffening of the rubber-elastic material is obtained by the compression so that the connecting end is reliably held on the cylinder flange.

The clamp ring advantageously has a width corresponding approximately to the width of the annular slot so that the compression of the rubber-elastic material is limited to the region of the annular slot. In this way, the rubber-elastic material of the connecting end which engages on the slot wall cannot be pressed against the boundary edges of the annular slot which could cause the induction elbow to become damaged.

The inner edge of the clamp ring facing toward the cylinder is beveled to facilitate pushing the clamp ring onto the connecting end. The bevel is preferably rounded.

The clamp ring is preferably made of plastic such as a glass-fiber reinforced polyamide. The connecting end is provided with an annular flange in order to prevent temperature from affecting the clamp ring. The annular flange is disposed axially between the clamp ring and the hot cylinder.

According to another feature of the invention, the clamp ring is configured so as to be part of the guide wall for the cool air flow with the clamp ring and the air guide wall preferably being injection molded as a single piece made of plastic such as a glass-reinforced polyamide. This is possible since the clamp ring does not change in diameter during assembly. After the connecting end of the induction elbow is pulled onto the cylinder flange, only the air guide wall must be inserted over the connecting end with the clamp ring effecting the compression of the rubber-elastic material in the region of the annular slot. The compression of the rubber-elastic material is limited to the region of the annular slot because the inner diameter of the connecting portion connecting the air guide wall to the clamp ring is greater than the inner diameter of the clamp ring.

BRIEF DESCRIPTION OF THE DRAWINGS

The invention will now described with reference to the drawings wherein.

DESCRIPTION OF THE PREFERRED EMBODIMENTS OF THE INVENTION

Figure 1:
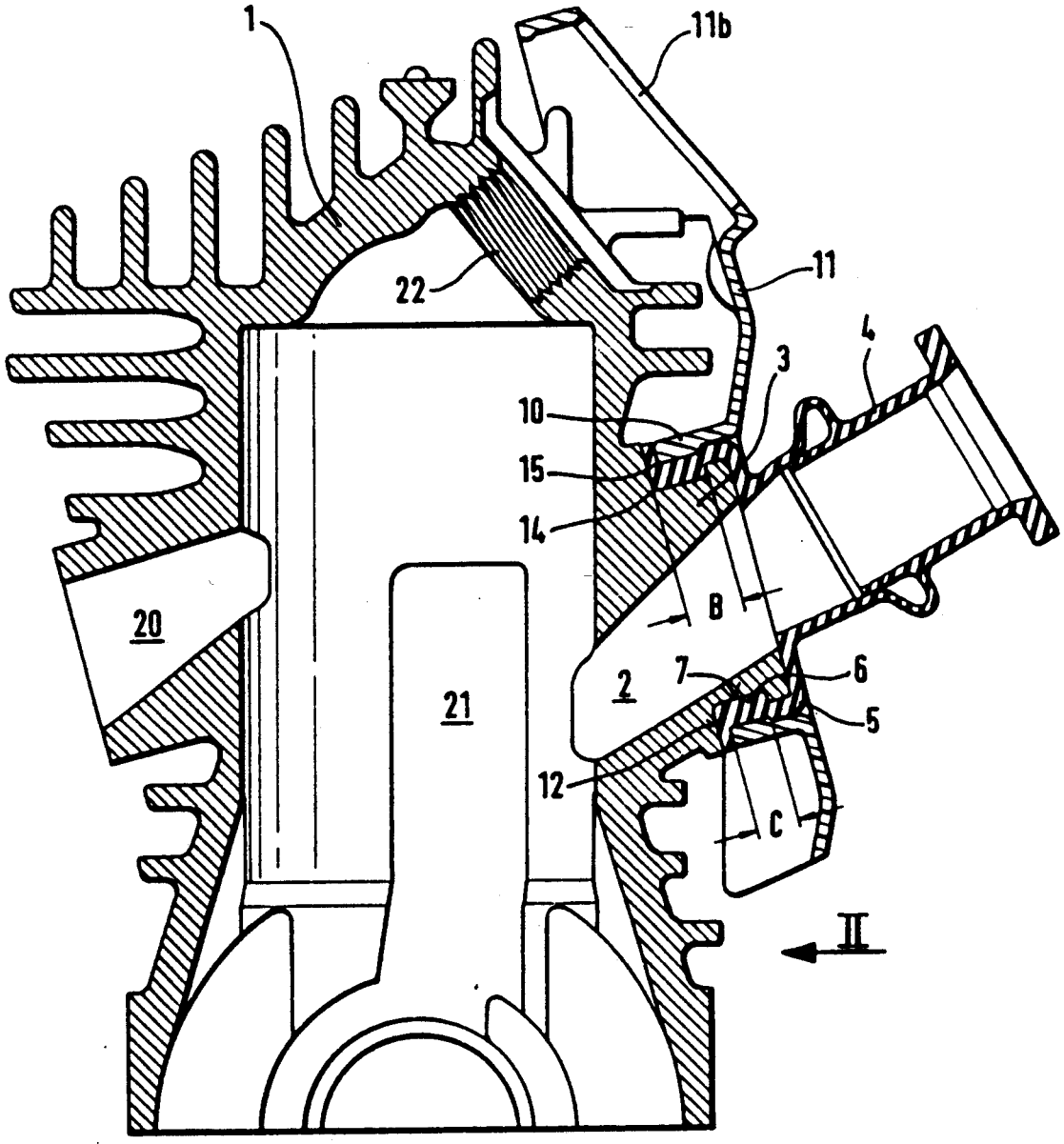
FIG. 1 is a side elevation section view taken through the cylinder having a cylinder flange on which an induction elbow is mounted and with the cylinder further being provided with an air guide wall.

The cylinder shown in section in FIG. 1 is part of a one-cylinder two-stroke engine for a portable handheld work apparatus such as a motor-driven chain saw, cutoff machine, brushcutter or the like. The cylinder 1 has a cylinder wall in which an inlet opening 2 is formed. The inlet opening 2 is surrounded by a cylinder flange 3 forming a connecting stub. An outlet opening 20 is provided in the wall of the cylinder lying opposite the inlet opening 2 and is displaced in elevation. Overflow channels 21 are also arranged in the cylinder wall. A threaded opening 22 is provided in the head of the cylinder for receiving a spark plug therein.

Figure 2:
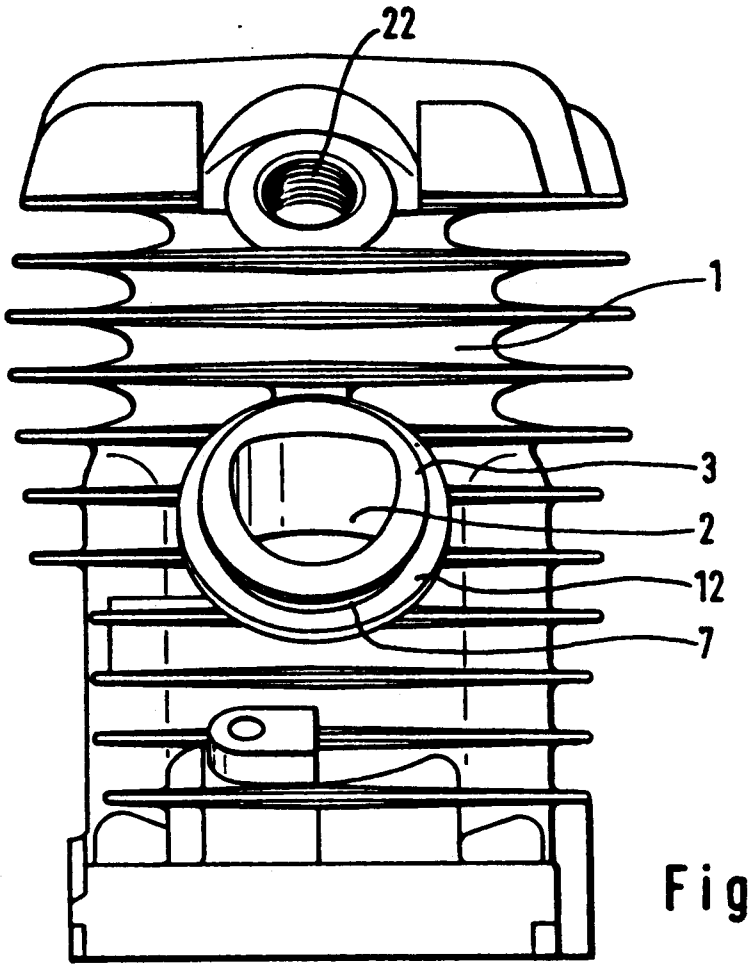
FIG. 2 is a view of the cylinder in the direction of arrow II of FIG. 1.

The cylinder flange 3 has an outer peripherally extending annular slot 7 (FIGS. 1 and 2). The annular slot is limited at the cylinder end by an annular surface 12. The annular surface 12 extends into the base of the annular slot 7 via a round 14 at its radial inner edge.

Figure 3:
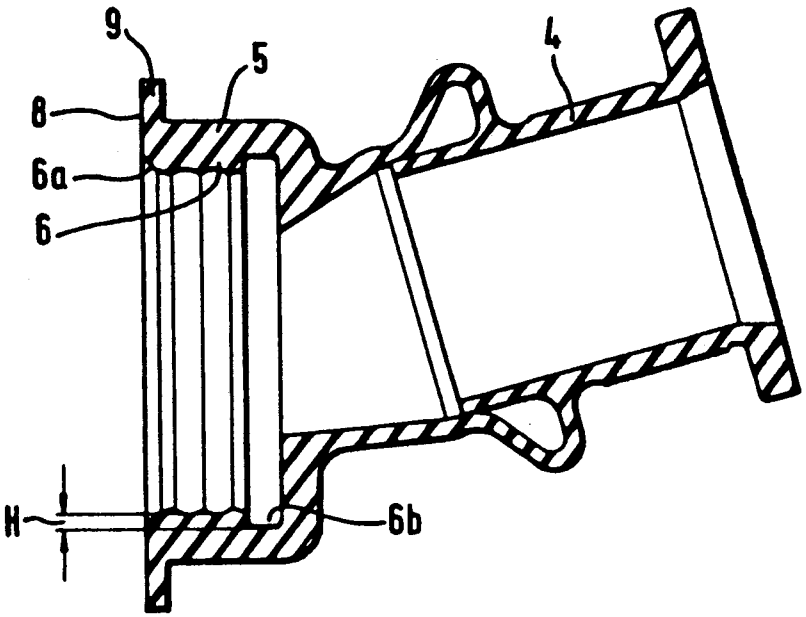
FIG. 3 is a section view taken through the induction elbow.

The connecting end 5 of an induction elbow 4 is pushed over the cylinder flange 3 with an inner annular shoulder 6 of the connecting end 5 engaging in the annular slot 7. The configuration of the induction elbow 4 and especially its connecting end 5 is shown in detail in FIG. 3. The induction elbow 4 is made of a rubber-elastic material such as VITON which is highly resistant to temperature. The connecting end 5 is configured to widen into the remaining induction elbow 4 in order to engage over the cylinder flange. The inner annular shoulder 6 has an elevation H which corresponds approximately to the depth of the slot 7. The edge 6*a* is formed between the annular shoulder 6 and the end face 8 of the connecting end 5 and is preferably steeply beveled. It can be advantageous to form this edge with a round. The annular shoulder 6 has an edge lying axially inwardly and facing toward the remaining portion of the induction elbow and this edge is preferably slightly beveled. The annular shoulder 6 facing toward the induction elbow is limited in the axial direction by a rearward annular recess 6*b*.

The connecting end 5 further includes an outer annular flange 9 at the elevation of its end face 8. The end face 8 is radially extended by this outer annular flange 9.

The connecting end configured in this manner is in effect snapped into place on the cylinder flange 3 with the annular shoulder 6 being adapted with respect to its volume to the annular slot 7 so that this shoulder is completely received in the slot 7. The forward end face 8 of the connecting end 5 is in contact engagement with the annular surface 12 of the cylinder flange 3. Preferably, the radial elevation of the annular surface 12 corresponds to the radial elevation of the annular-shaped end face 8 of the connecting end 5.

A clamp ring 10 is pushed over the connecting end 5 to secure the connecting end 5 in position on the cylinder flange 3. The axial width C of the clamp ring 10 corresponds approximately to the width B of the annular slot 7 less the thickness of the annular flange 9. The clamp ring is effective only in the region of the annular slot 7 because of its dimensions. The clamp ring is configured with respect to its unchangeable diameter such that it presses the volume of the rubber-elastic connecting end into the annular slot 7 whereby a reliable connection of the connecting end 5 on the cylinder flange is assured which cannot become disconnected.

The radial inner edge 15 of the clamp ring 10 is preferably beveled or rounded on the end facing toward the cylinder in order to reduce the danger of damage to the material when the clamp ring is pushed over the connecting end 5 to facilitate a simple fitting of the clamp ring on the connecting end.

The clamp ring 10 is advantageously made of a plastic such as glass-reinforced polyamide with the annular flange 9 of the induction elbow 4 coming to rest between the hot cylinder 1 and the end face 16 of the clamp ring 10 facing toward the cylinder during assembly. The temperature-resistant, rubber-elastic material of the annular flange 9 in this way protects the plastic ring 10 against temperatures which are too high and which otherwise could lead to damage, especially to a reduction of the clamping forces.

Figure 5:
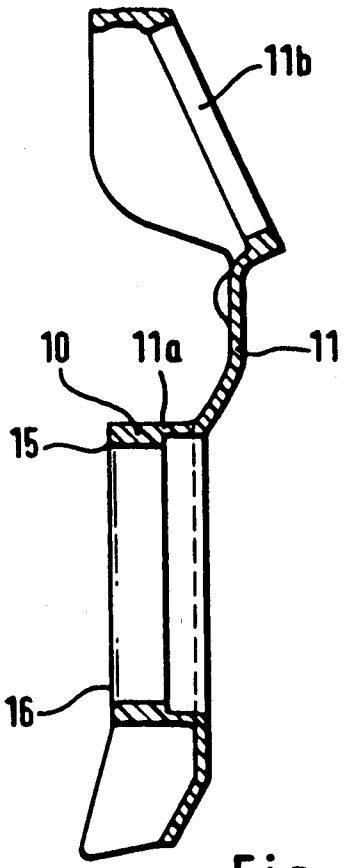
FIG. 5 is a section view taken through the air guide wall along the line V—V of FIG. 4.
Figure 4:
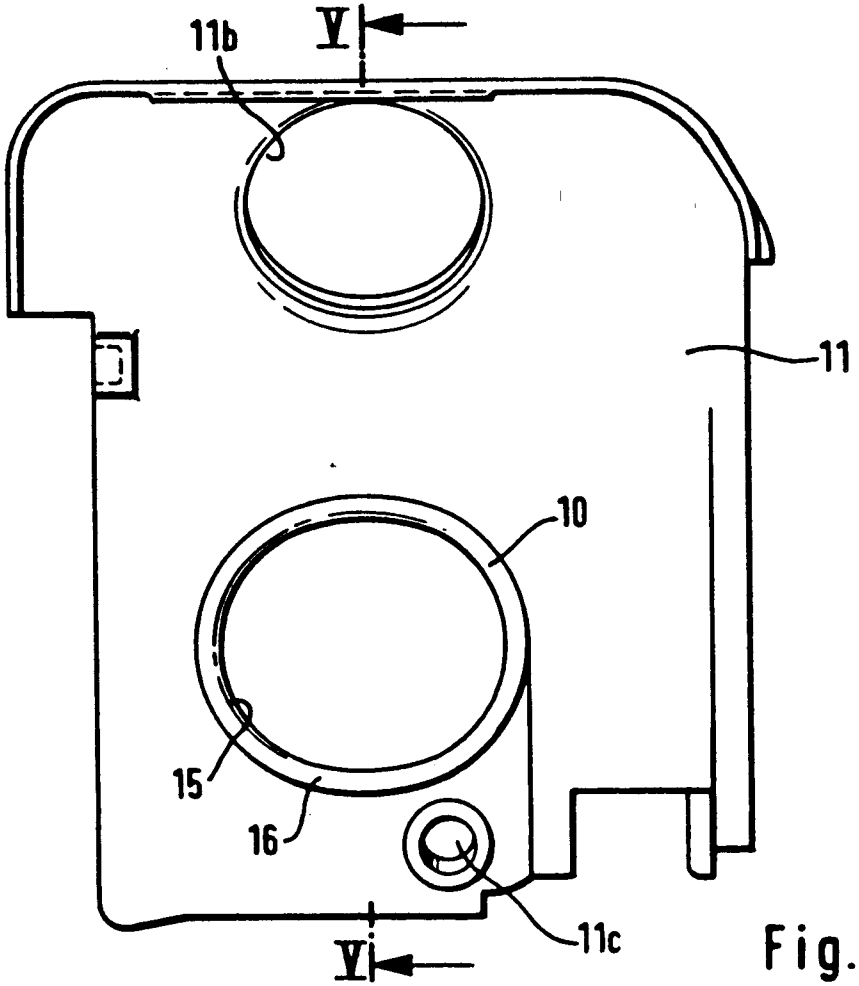
FIG. 4 is a view of the end of the guide wall facing toward the cylinder.

The clamp ring 10 is preferably configured as a single piece with an air guide wall 11 as shown in FIG. 1 and in detail in FIGS. 4 and 5. The air guide wall 11 guides cooling air around the cylinder 1. The air guide wall is produced together with the clamp ring 10 as an injection-molded part with the air guide wall 11 preferably extending from the clamp ring 10 in the axial direction in order to provide an appropriate spacing between the cylinder 1 and the air guide wall 11. The air guide wall 11 extends axially into the clamp ring 10 with the axial cylindrical connecting portion 11*a*. The connecting portion 11*a* has an inner diameter which is greater than the inner diameter of the clamp ring 10. The air guide wall 11 has an opening 11*b* corresponding to the spark plug opening 22 of the cylinder 1 as well as an opening 11*c* lying below the clamp ring 10 for passing through a tube.

In the embodiment shown, the cross section of the cylinder flange 3 is configured so as to be slightly oval as shown in FIG. 2 with the connecting end 5 as well as the clamp ring 10 having a corresponding form. In this way, an assembly of the induction elbow on the cylinder flange which is correct with respect to position is assured. Other cross-sectional configurations deviating from a circular shape can be advantageous.

It is understood that the foregoing description is that of the preferred embodiments of the invention and that various changes and modifications may be made thereto without departing from the spirit and scope of the invention as defined in the appended claims.

What is claimed is:

1. An internal combustion engine for a portable handheld tool such as a motor-driven chain saw, cutoff machine or the like, the internal combustion engine comprising:

a cylinder having a cylinder wall defining a combustion chamber;

said cylinder wall having an inlet opening formed therein for passing a combustion mixture into said combustion chamber;

said cylinder wall defining a flange formed in surrounding relationship to said inlet opening;

an induction elbow for passing the combustion mixture into said inlet opening, said induction elbow being made of a rubber-elastic material and having a connecting end for connecting said induction elbow to said flange;

said connecting end defining an inner wall surface having an annular shoulder formed thereon so as to have a first volume;

said flange having an annular slot formed therein so as to have a second volume approximately equal to said first volume;

said connecting end being mounted on said flange with said shoulder being disposed in said slot;

a clamp ring having a fixed inner diameter;

said clamp ring being pushed over said connecting end for holding said connecting end on said flange;

said clamp ring having an inner clamping surface defining said fixed inner diameter and said clamping surface and said slot conjointly defining a space therebetween when said clamp ring is pushed over said connecting end; and, said fixed inner diameter of said clamp ring being selected so as to cause said clamping surface to radially compact said annular shoulder in said space to stiffen the material of said annular shoulder thereby securely connecting said connecting end to said flange.

2. The internal combustion engine of claim 1, said engine being a two-stroke engine.

3. The internal combustion engine of claim 1, said annular slot having a width (B) and said clamp ring having a width (C) corresponding approximately to said width (B).

4. The internal combustion engine of claim 1, said clamp ring having an end face directed toward said cylinder; and, said end face being beveled.

5. The internal combustion engine of claim 1, said clamp ring having an end face directed toward said cylinder; and, said end face being rounded.

6. An internal combustion engine for a portable handheld tool such as a motor-driven chain saw, cutoff machine or the like, the internal combustion engine comprising:

a cylinder having a cylinder wall defining a combustion chamber;

said cylinder wall having an inlet opening formed therein for passing a combustion mixture into said combustion chamber;

said cylinder wall defining a flange formed in surrounding relationship to said inlet opening;

an induction elbow for passing the combustion mixture into said inlet opening, said induction elbow being made of a material having a rubber elasticity and having a connecting end for connecting said induction elbow to said flange;

said connecting end defining an inner wall surface having an annular shoulder formed thereon;

said flange having an annular slot formed therein so as to have a volume adapted to said shoulder;

said connecting end being mounted on said flange with said shoulder being disposed in said slot;

a clamp ring having a fixed diameter and said clamp ring being pushed over said connecting end for holding said connecting end on said flange while compacting the material of said connecting end;

said clamp ring having an end face directed toward said cylinder;

said clamp ring being made of plastic;

said connecting end having an annular flange formed thereon; and, said annular flange being disposed between said cylinder and said end face of said clamp ring.

7. The internal combustion engine of claim 6, said clamp ring being made of a glass-fiber reinforced polyamide.

8. The internal combustion engine of claim 6, said cylinder having an annular surface formed thereon in surrounding relationship to said flange; and, said annular flange of said connecting end being seated against said annular surface when said induction elbow is mounted on said flange.

9. The internal combustion engine of claim 8, said annular slot having a base; and, said annular end face and said base conjointly defining a rounded surface connecting said annular end face to said base.

10. An internal combustion engine for a portable handheld tool such as a motor-driven chain saw, cutoff machine or the like, the internal combustion engine comprising:

a cylinder having a cylinder wall defining a combustion chamber;

said cylinder wall having an inlet opening formed therein for passing a combustion mixture into said combustion chamber;

said cylinder wall defining a flange formed in surrounding relationship to said inlet opening;

an induction elbow for passing the combustion mixture into said inlet opening, said induction elbow being made of a material having a rubber elasticity and having a connecting end for connecting said induction elbow to said flange;

said connecting end defining an inner wall surface having an annular shoulder formed thereon;

said flange having an annular slot formed therein so as to have a volume adapted to said shoulder;

said connecting end being mounted on said flange with said shoulder being disposed in sad slot;

a clamp ring having a fixed diameter and said clamp ring being pushed over said connecting end for holding said connecting end on said flange while compacting the material of said connecting end;

a cooling air guide wall for guiding cooling air to said cylinder; and, said cooling air guide wall including said clamp ring as a part of said guide wall.

11. The internal combustion engine of claim 10, said clamp ring and said guide wall being configured as a single piece.

12. The internal combustion engine of claim 10, said clamp ring having an inner diameter; said guide wall having a connecting portion extending axially into said clamp ring; and, said connecting portion having an inner diameter greater than said inner diameter of said clamp ring.

13. The internal combustion engine of claim 1, said clamp ring being made of a glass-fiber reinforced polyamide.

14. The internal combustion engine of claim 13, said cylinder having an annular surface formed thereon in surrounding relationship to said flange; and, said annular flange of said connecting end being seated against said annular surface when said induction elbow is mounted on sad flange.

15. The internal combustion engine of claim 14, said annular slot having a base; and, said annular end face and said base conjointly defining a rounded surface connecting sad annular end face to said base.

* * * * *

UNITED STATES PATENT AND TRADEMARK OFFICE

CERTIFICATE OF CORRECTION

PATENT NO. : 5,065,708

DATED : November 19, 1991

INVENTOR(S) : Anton Wehle, Klaus Hopper and Hermann Weiss

It is certified that error appears in the above-identified patent and that said Letters Patent is hereby corrected as shown below:

In column 6, line 46: delete "sad" and substitute -- said -- therefor.

In column 7, line 4: delete "sad" and substitute -- said -- therefor.

In column 8, line 3: delete "sad" and substitute -- said -- therefor.

Signed and Sealed this

Twentieth Day of April, 1993

*Attest:*

MICHAEL K. KIRK

*Attesting Officer*

*Acting Commissioner of Patents and Trademarks*